US006242996B1

(12) United States Patent
Sato et al.

(10) Patent No.: US 6,242,996 B1
(45) **Date of Patent: *Jun. 5, 2001**

(54) SURFACE MOUNT SELF-INDUCTION COMPONENT

(75) Inventors: Kouki Sato; Katsumi Saito, both of Tokyo (JP)

(73) Assignee: TDK Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/410,765

(22) Filed: Oct. 1, 1999

(30) Foreign Application Priority Data

Oct. 27, 1998 (JP) ..... 10-305262

(51) Int. Cl.[7] ..... H01F 5/00; H01F 27/02

(52) U.S. Cl. ..... 336/200; 336/83; 336/174; 336/198

(58) Field of Search ..... 336/198, 208, 336/200, 192, 83, 174

(56) References Cited

U.S. PATENT DOCUMENTS

| | | | |
|---|---|---|---|
| 3,593,217 | | 7/1971 | Weber . |
| 5,369,389 | * | 11/1994 | Schrammek et al. ..... 336/206 |
| 5,559,918 | * | 9/1996 | Furuyama et al. ..... 385/92 |

FOREIGN PATENT DOCUMENTS

| | | |
|---|---|---|
| 0 071 306 | 2/1983 | (EP) . |
| 0 845 792 | 6/1998 | (EP) . |
| 2-91317 | 7/1990 | (JP) . |
| 2-110309 | 9/1990 | (JP) . |
| 4-88012 | 7/1992 | (JP) . |
| 4-88014 | 7/1992 | (JP) . |
| 5-62022 | 8/1993 | (JP) . |
| 8-186028 | 7/1996 | (JP) . |
| 8-213248 | 8/1996 | (JP) . |
| 9-219318 | 8/1997 | (JP) . |

OTHER PUBLICATIONS

Patent Abstracts of Japan, vol. 1998, No. 11, Sep. 30, 1998, JP 10 163029, Jun. 19, 1998.
Patent Abstracts of Japan, vol. 1996, No. 11, Nov. 29, 1996, JP 08 186028, Jul. 16, 1996.

* cited by examiner

*Primary Examiner*—Anh Mai
(74) *Attorney, Agent, or Firm*—Oblon, Spivak, McClelland, Maier & Neustadt, P.C.

(57) ABSTRACT

A surface mount self-induction component comprises a drum core having a winding core around which a winding is to be wound, and a pair of flanges which are opposedly placed at ends of the winding core, respectively, a plate core which elongates above the pair of flanges, and electrodes which are respectively formed on side faces of the opposed flanges, the side faces being parallel with an axial direction of the winding core, a diameter of the winding being collapsed by pressurizing or heating, thereby connecting terminals of the winding to said electrodes.

14 Claims, 6 Drawing Sheets

SURFACE MOUNT SELF-INDUCTION COMPONENT

BACKGROUND OF THE PRESENT INVENTION

The present invention relates to a surface mount self-induction component which is used in, for example, a transmitting and receiving circuit, a noise filter, a current detection circuit that are useful in a portable telephone, a video camera, a computer, and the like, and more particularly to a common mode filter.

As a surface mount self-induction device of the prior, known are a device such as a common mode filter 300 of FIG. 12 in which a drum core 100 and a tubular core 200 are combined with each other to form a closed magnetic path, and a device having a structure in which external electrodes are formed on a resin sheath and a winding wound around a core is connected to the electrodes.

Recently, miniaturization of an electronic apparatus is rapidly advancing. As a result, also a surface mount self-induction component such as an inductor which is an internal component of an electronic apparatus is requested to be further miniaturized.

However, the configuration of a component such as the common mode filter 300 of FIG. 12 hardly fulfills such a request. Namely, the tubular core 200 and the resin sheath are restricted in size and hence it is very difficult to miniaturize the component in a large degree.

In order to comply with the above, miniaturized surface mount self-induction components are proposed in Japanese Patent Publications (Kokai) Nos. HEI8-213248 (shown in FIG. 13) and HEI8-186028.

The surface mount self-induction component shown in FIG. 13 is a chip inductor. Electrodes 20A and 20B each configured by a film-like conductor are formed on the lower faces of end flanges 30A and 30B of a magnetic core 10 which is a molded product of a metal oxide, respectively. A winding 40 is connected to the electrodes. A heat resisting film 50 is joined to the upper face of the winding 40 by an adhesive agent 60 so as to bridge the upper faces of the flanges 30A and 30B. By contrast, the surface mount self-induction component of Japanese Patent Publication (Kokai) No. HEI8-186028 is a wound chip inductor having a gap. The publication shows that the invention is configured by forming a flange having a cross section shape on each of the opposed ends of a winding shaft of a core of the closed magnetic path type, directly forming an electrode on a lower side face of each of the opposed cross flanges, connecting terminals of a winding wound around the winding shaft to the electrodes, and attaching an I-core to upper portions of the flanges via a gap forming medium.

In the induction components disclosed in the publications, the size restrictions due to a tubular core and a resin sheath are not imposed, and hence the components can be miniaturized.

Recently, particularly in a portable electronic apparatus or the like (for example, a portable CD player, a portable MD player, or a portable information terminal), the thickness of the apparatus is extremely reduced as miniaturization of the apparatus is advancing. Therefore, a surface mount self-induction component serving as an internal component must be configured so as to be thinner. With respect of this point, the prior art components of FIG. 13 and Japanese Patent Publication (Kokai) No. HEI8-186028 have the following problems.

In the induction component of FIG. 13, terminals of the winding are connected to the lower-face electrodes formed on the lower faces of the flanges. As the wire of the winding has a larger diameter, therefore, the height of the component is larger.

By contrast, in the induction component of Japanese Patent Publication (Kokai) No. HEI8-186028, the electrodes are formed directly on the lower side faces of the opposed cross flanges, and the winding is connected to the electrodes. As the winding has a larger diameter, therefore, the heights of the lower side faces of the flanges are larger, with the result that the total height of the component becomes larger. It may be contemplated to employ a configuration in which the winding core is made smaller in diameter so that the winding can be made thicker without changing the total height of the component. When the winding core is made smaller in diameter, however, the inductance becomes smaller so that the properties are impaired. Therefore, this configuration is not preferable. Moreover, the connecting positions of the winding exist on the lower side faces of the cross flanges. Consequently, the connection of the winding is hardly performed by means of machinery, and hence the productivity is poor.

Because of these reasons, thinning of a surface mount self-induction component of the prior art inevitably causes the diameter of a winding to be reduced. As a result, the current capacity is reduced.

Even in the above-mentioned field of an electronic apparatus where thinning is particularly advancing, however, a part of surface mount self-induction components are often required to have a large current capacity. In order to trap noises before entering an electronic apparatus and diffusing therein, for example, a surface mount self-induction component which is used for eliminating noises, such as a common mode filter is preferably used also in an input/output portion of the electronic apparatus. Usually, a very large current (about 2,000 mA) flows in an input/output portion of an electronic apparatus.

Particularly in the field of an electronic apparatus, therefore, it is eagerly requested to develop a surface mount self-induction component which can cope with thinning of an electronic apparatus and which has a sufficient current capacity. However, the prior art cannot sufficiently satisfy such a requirement. In order to improve not only the properties but also the productivity, moreover, it is requested to facilitate the production of such a component by means of machinery. However, the prior art hardly copes with automation.

SUMMARY OF THE INVENTION

It is an object of the invention to provide a surface mount self-induction component, particularly a common mode filter which can maintain a large current capacity while sufficiently coping with thinning of an electronic apparatus, and which can be easily produced by means of machinery.

In order to solve the problems, the following measures are employed.

(1) A surface mount self-induction component comprising a drum core having two flanges which are opposed to a winding core, a circuit being formed by a winding, wherein the component has one electrode on each of two or four peripheral side faces of the opposed flanges, and connections of terminals of the winding are realized by means of the electrodes on the peripheral side faces of the opposed flanges.

(2) A surface mount self-induction component comprising a drum core having two flanges which are opposed to a winding core, a circuit being formed by a winding, wherein the component has one or two electrodes on each of back faces of the opposed flanges, and connections of terminals of the winding are realized by means of the electrodes on the back faces of the opposed flanges.

(3) A surface mount self-induction component of (1) above, wherein one electrode is formed on each of four peripheral side faces of the opposed flanges, and connections of terminals of the windings are realized by means of electrodes formed on the peripheral side faces.

(4) A surface mount self-induction component of (2) above, wherein two electrodes are formed on each of the back faces of the opposed flanges, and connections of terminals of the windings are realized by means of electrodes formed on the back faces of the flanges.

(5) A surface mount self-induction component of (1) to (4) above, wherein a plate core is joined to the drum core. (6) A surface mount self-induction component of (1) to (5) above, wherein a chamfered portion is formed in an edge of each of the opposed flanges.

(7) A surface mount self-induction component of (1) to (6) above, wherein the winding core has a rectangular section shape, and has a chamfered portion in each edge.

(8) A surface mount self-induction component of (5) to (7) above, wherein joining of the drum core and the plate core is performed only through upper faces of the flanges.

(9) A surface mount self-induction component of (5) to (8) above, wherein joining of the drum core and the plate core is performed by an ultraviolet curing resin.

(10) A surface mount self-induction component of (1) to (9) above, wherein connections of input and output terminals of the winding are realized by means of corresponding electrodes formed on one of the opposed flanges.

(11) A surface mount self-induction component of (1) to (10) above, wherein two windings are used, connections of input and output terminals of one of the windings are realized on corresponding peripheral side faces of one of the opposed flanges, and connections of input and output terminals of the other of the windings are realized on corresponding peripheral side faces of the other of the opposed flanges.

DETAILED DESCRIPTION OF THE PREFERRED EMBODIMENTS

Hereinafter, embodiments of the invention will be described with taking a common mode filter as an example.

Figure 1:
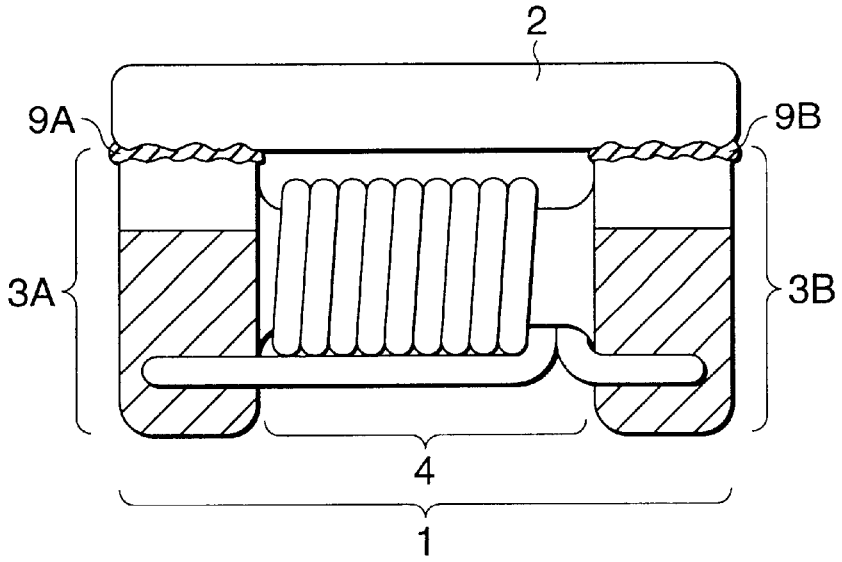
FIG. 1 is a front view of a completed common mode filter which is an example of the surface mount self-induction component of the invention.
Figure 2:
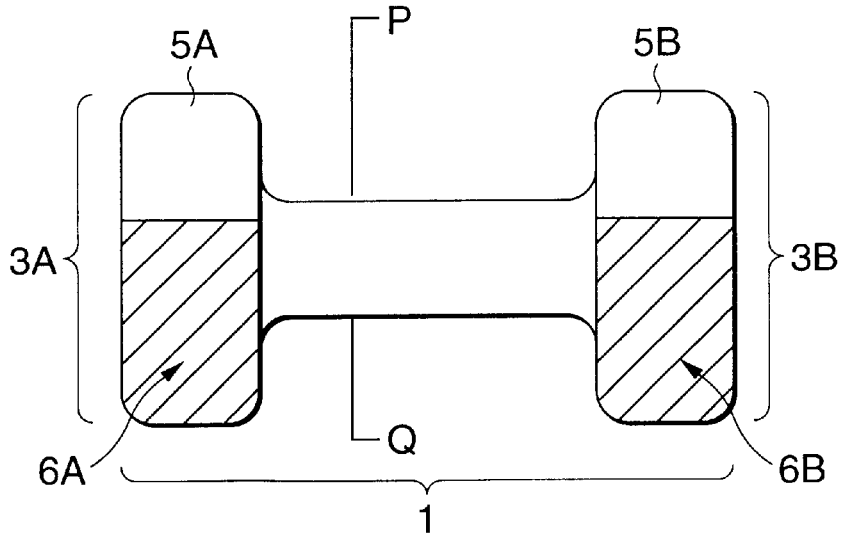
FIG. 2 is a front view of a drum core of the common mode filter of FIG. 1, electrodes being formed on the drum core.

FIG. 1 is a front view showing an embodiment of a common mode filter according to the invention. In the figure, 1 denotes a drum core, 2 denotes a plate core, 4 denotes a winding core of the drum core 1, and 3A and 3B denote flanges which are opposed to the winding core 4. These cores are made of a material in which the permeability can be arbitrarily selected in accordance with the design, such as ferrite. In FIG. 1, 9A and 9B denote an adhesive agent which is applied to joining portions between the drum core and the plate core. As the adhesive agent, preferably, used is a material such as an ultraviolet curing resin which is curable for a short time period. The adhesive agent is preferably applied only to upper faces of the flanges of the drum core, so that the drum core 1 and the plate core 2 are positioned without producing misalignment. In this case, a load is applied, and the adhesive agent protruding from the joining interface is irradiated with ultraviolet rays to be provisionally cured. Thereafter, the main curing process is performed to attain the joining strength. Since the adhesive agent is applied only to the upper faces of the flanges 3A and 3B, electrolytic corrosion due to an adhesive agent which may adhere to the winding can be prevented from occurring, and the drum core can be prevented from being destroyed by stress produced in the adhesive agent. The use of the adhesive agent which can be cured for a short time period improves the productivity. FIG. 2 is a front view of the drum core 1 on which electrodes are formed, and FIG. 3 is a rear view of the core.

Figure 3:
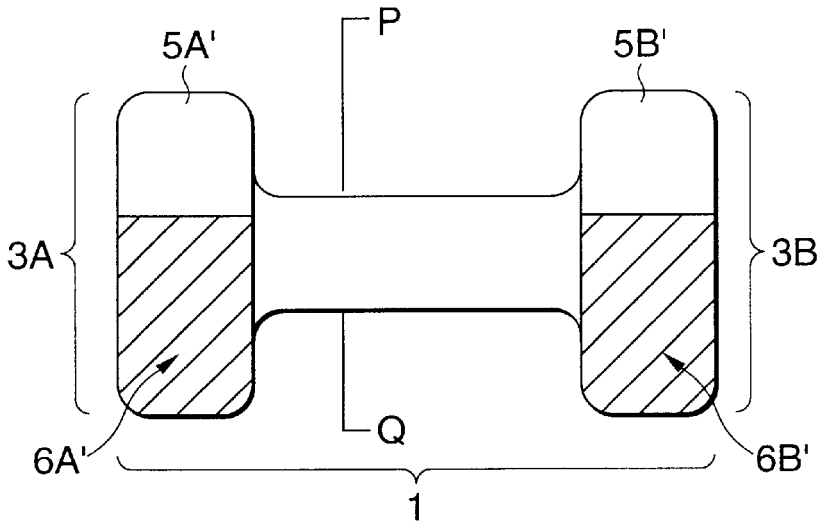
FIG. 3 is a rear view of the drum core of the common mode filter of FIG. 1, electrodes being formed on the drum core.

Referring to FIGS. 2 and 3, electrodes 6A and 6B, and 6A' and 6B' are formed on peripheral side faces 5A and 5B of the flanges 3A and 3B, and peripheral side faces 5A' and 5B' which correspond to the peripheral side faces 5A and 5B, respectively. As a result, in the embodiment, one electrode is formed on each of all the four side faces. In some surface mount self-induction components such as an inductor, only one winding is used. In such a component, one electrode is formed on each of two of the four peripheral side faces 5A, 5B, 5A', and 5B'.

Each electrode is formed by applying a silver paste and then baking the paste at a high temperature. When soldering is to be conducted without visual checking, the applied amount of the electrode material is preferably suppressed to a minimum level at which connection of the winding can be realized. The suppression of the applied amount of the electrode material to the minimum level can reduce the production cost. By contrast, when soldering is to be conducted with visual checking, the electrodes often serve as an index for positioning in the soldering, and hence the applied amount is adjusted as required.

Figure 4:
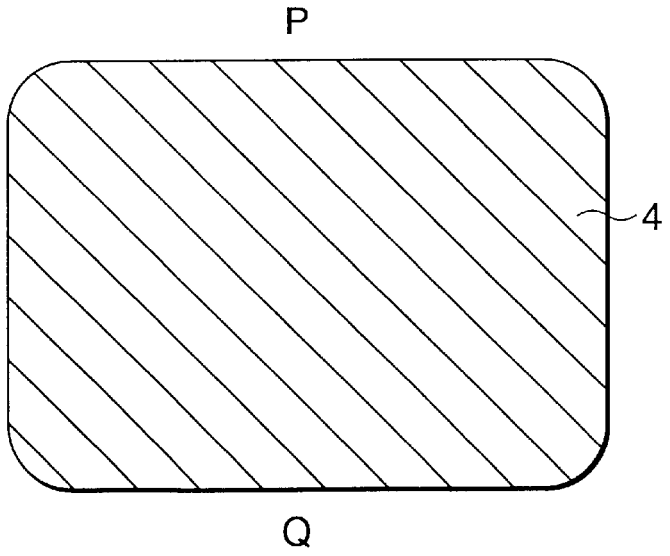
FIG. 4 is a section view of a winding core of the drum core of the common mode filter of FIG. 1.

Preferably, the winding core of the drum core has a rectangular shape because, in the case of a core having a circular column-like shape, untying or loosening of a winding occurs with a high possibility and hence the properties may be lowered. When the winding core has a rectangular shape, it is possible to prevent the winding from untying or loosening. Even when the winding is formed by mechanical means, therefore, a product of high performance can be obtained. More preferably, a chamfered portion is formed in each edge of the winding core. FIG. 4 is a section view of the winding core 4 and taken along the line P and Q in FIGS. 2 and 3. The winding core is chamfered because, when the winding core remains to have a rectangular shape, a stress is applied to the wire of the winding and the insulation coating is easily broken. When the winding core is chamfered, a stress applied to the winding can be reduced so as to prevent the insulation coating from being broken. Because of the same reason, edges of the opposed flanges 3A and 3B are preferably chamfered. This chamfering may be performed by removing away mainly edges of the outer periphery by means of blasting f fine sand or polishing. Alternatively, edges may be previously formed as a curved face during the process of molding the core.

Figure 5:
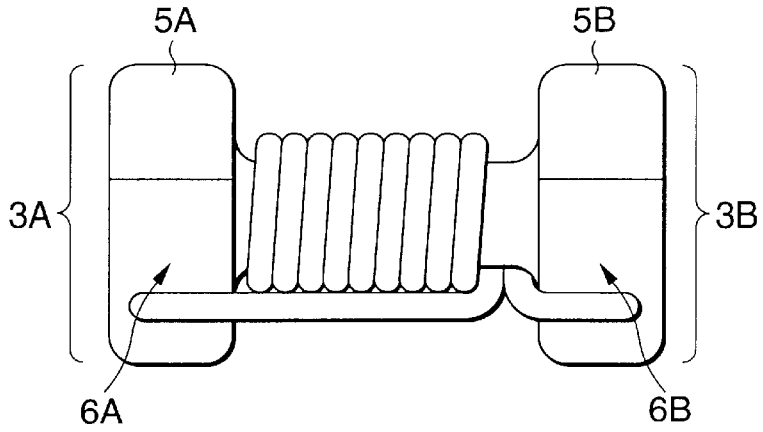
FIG. 5 is a front view showing portions where winding terminals are connected in the common mode filter of FIG. 1.
Figure 6:
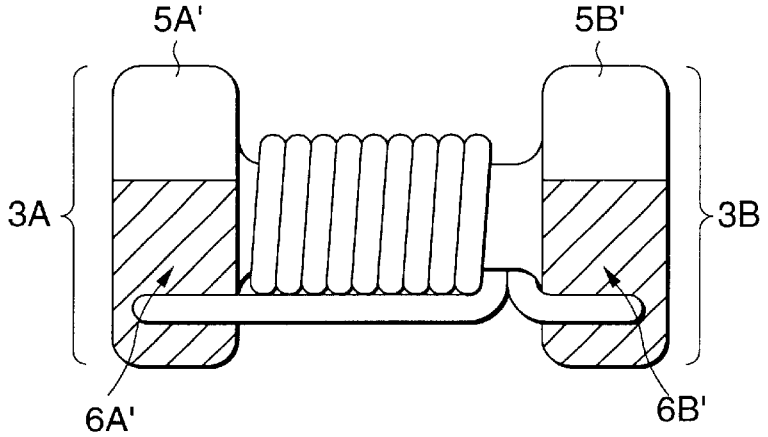
FIG. 6 is a rear view showing the portions where the winding terminals are connected in the common mode filter of FIG. 1.

FIG. 5 is a front view showing a configuration where terminals of the winding are connected to external electrodes, and FIG. 6 is a rear view of the configuration. In the configuration shown in FIGS. 5 and 6, connections of the terminals of the winding are performed by the electrodes 6A and 6B formed on the peripheral side faces of the flanges 3A and 3B, and the electrodes 6A' and 6B' which correspond to the electrodes 6A and 6B.

According to the connecting positions of the winding, even when a thick winding having a large current capacity is used, it is possible to suppress the height of the resulting product.

Figure 12:
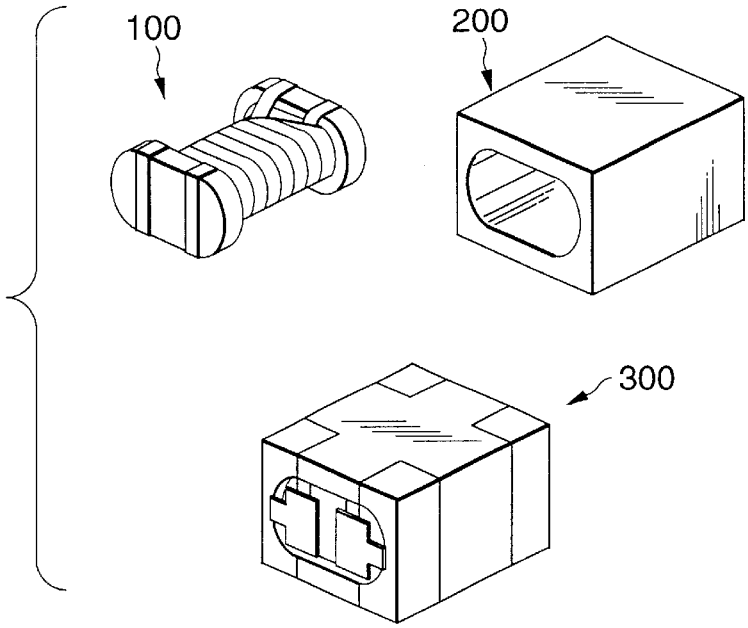
FIG. 12 is a perspective view and an exploded view of a completed common mode filter which is an example of a surface mount self-induction component of the prior art.
Figure 13:
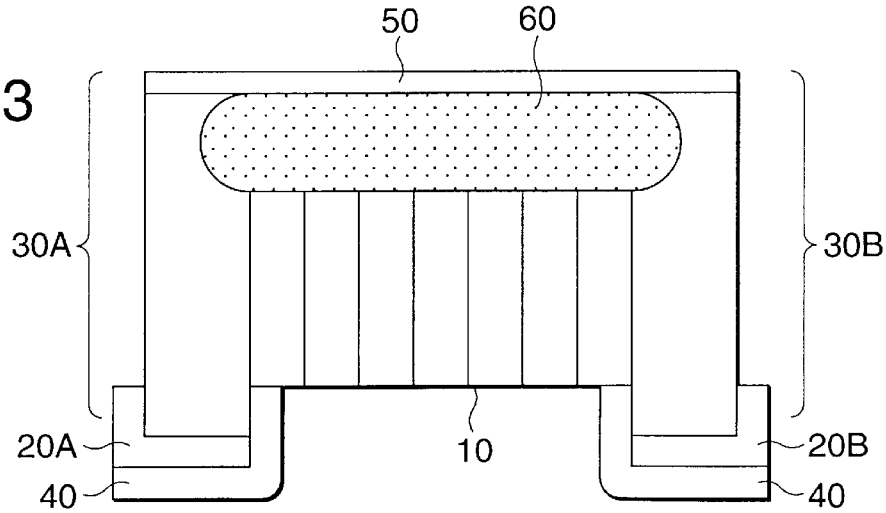
FIG. 13 is a front view of a completed chip inductor which is another example of a surface mount self-induction component of the prior art.

Conventionally, a common mode filter (FIG. 12) which is used in a thin electronic apparatus such as a portable CD player, a portable MD player, or a portable information terminal has only a current capacity of about 300 mA per a component height of 2.3 mm, and hence cannot be used in an input/output portion which requires a current capacity of about 2,000 mA. In such an electronic apparatus, therefore, a countermeasure against noises is insufficiently taken. According to the invention, it is possible to provide a common mode filter (a current capacity of 2,000 mA at the component height of 1.8 mm) which can sufficiently cope with in an input/output portion of such an electronic apparatus, so that noises are trapped before diffusing in the electronic apparatus. Furthermore, the connecting positions of the winding terminals do not exist on the lower face. Even in the case where a winding having a large diameter is used, therefore, it is possible to prevent a resulting product from rattling when the product is connected to a circuit board.

Figure 7:
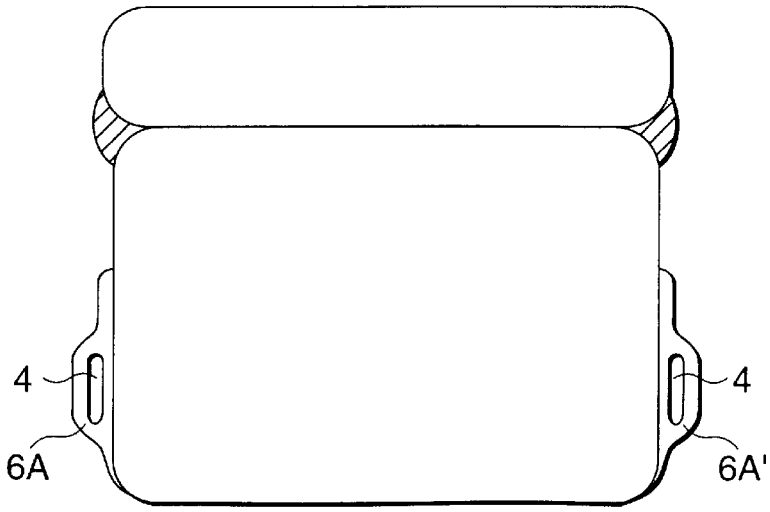
FIG. 7 is a view showing a connection state of thick winding terminals in the common mode filter of FIG. 1.

FIG. 7 is a rear view of a component according to the invention in which a thick winding is used. Connections of terminals of the winding are performed in the following manner. A load and heat (about 370° C.) are applied by a soldering iron on which a thin film of solder is formed, so as to soften copper, thereby collapsing the diameter of the winding by about 50%. At the same time, Sn plating which has been formed in order to provide the electrodes with solder wettability, and the film-like solder covering the tip of the iron are caused to move to the outer periphery of the wire, whereby electrical connection is accomplished. As illustrated in FIG. 7, according to this connecting method, also a round winding can be pressingly collapsed, and hence the width of the component is not increased even when a thick winding is used. When a surface mount component is mounted on a face of a circuit board, a swollen solder portion which is called a fillet is usually formed around an external electrode of the component. Each of the connecting portions of the winding in the invention is covered by such a fillet. When the component of the invention is mounted on a circuit board, therefore, the width of the whole of the component is substantially equal to that of a surface mount self-induction component of the prior art.

Figure 8:
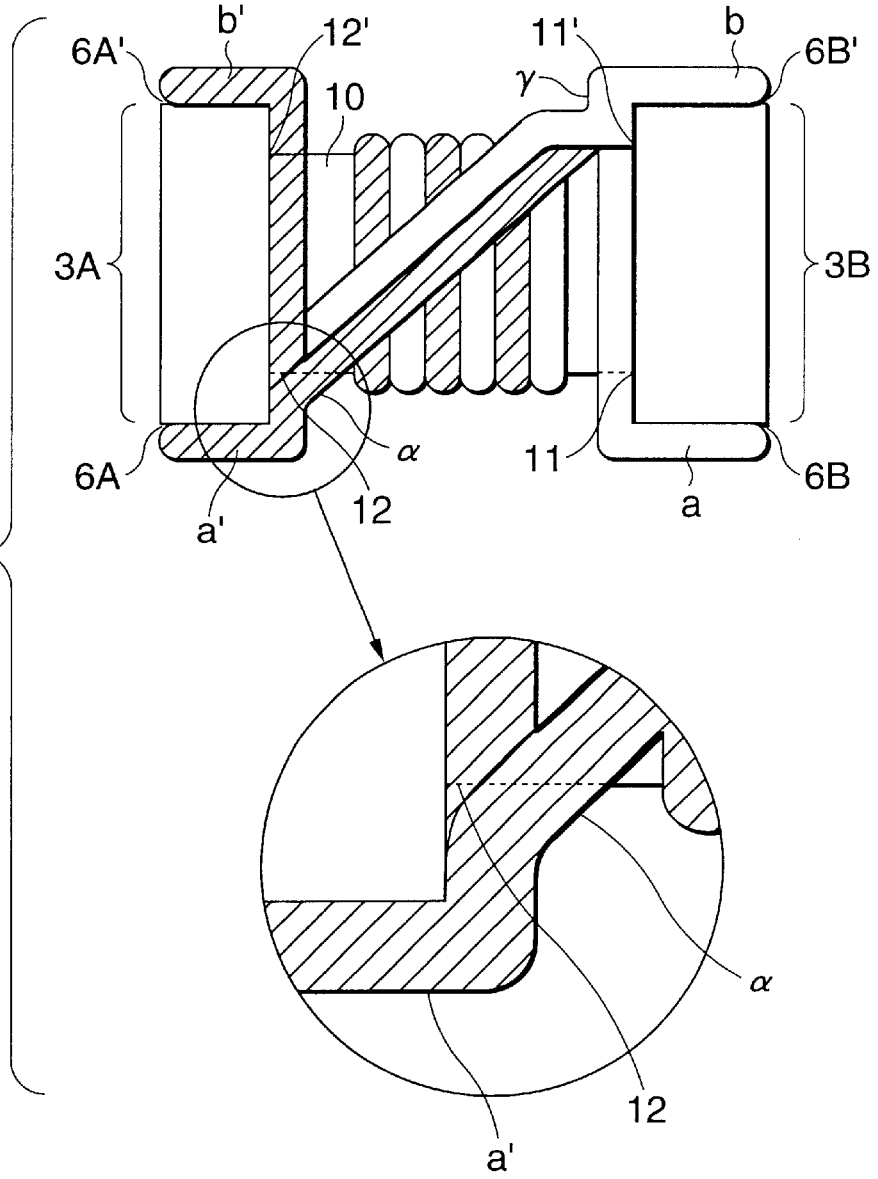
FIG. 8 is a diagram showing winding and connection states of windings in the common mode filter of FIG. 1.

FIG. 8 is a view diagrammatically showing a wound state of windings and the connection state of the terminals, as seen from the side of the lower face of a drum core. In the figure, lower-face electrodes are not shown. The windings shown in the figure are wound in the following manner. In the diagram of FIG. 8, two windings, i.e., a winding X (unhatched) and a winding Y (hatched) are used. (1) Before starting the winding process, the winding starting ends a and a' of the windings X and Y are provisionally fastened (not illustrated). (2) The processes of winding the windings X and Y are simultaneously started at one end 11 of the lower face 10 of the winding core. (3) The processes of winding the windings X and Y are simultaneously finished at one end 12 of the lower face of the winding core and opposed to the one end 11 of the lower face of the winding core at which the processes of winding the windings are started. (4) The winding starting ends a and a' of the windings X and Y are unfastened from the provisional fastening positions, and separated at one end 11' which corresponds to the one end 11 of the lower face 10 of the winding core at which the processes of winding the windings are started. (5) The winding finishing ends b and b' of the windings X and Y are separated at the one end 12 of the lower face 10 of the winding core at which the processes of winding the windings are finished. (6) The winding starting end a of the winding X or one of the separated windings is connected to an electrode on the peripheral side face 6B of the flange 3B which is adjacent via a step to the one end 11 of the lower face 10 of the winding core at which the processes of winding the windings are started. (7) The winding finishing end b of the winding X or one of the separated windings is connected to an electrode on the peripheral side face 6B' which corresponds to the electrode on the peripheral side face 6B of the flange to which the winding starting end a of the winding X is connected. (8) The winding starting end a' of the winding Y or the other of the separated windings is connected to an electrode on the peripheral side face 6A of the flange 3A which is adjacent via a step to the one end 12 of the lower face 10 of the winding core at which the winding finishing ends b and b' of the windings are separated. (9) The winding finishing end b' of the winding Y or the other of the separated windings is connected to an electrode on the peripheral side face 6A' of the flange 3A which corresponds to the peripheral side face 6A of the flange to which the winding starting end a' of the winding Y is connected.

The winding starting ends a and a' serve as input terminals, and the winding finishing ends b and b' as output terminals. In the embodiment, therefore, the input and output terminals a and b of the one winding X are respectively connected to the corresponding peripheral side faces 6B and 6B' of the opposed one flange 3B. By contrast, the input and output terminals a' and b' of the other winding Y are respectively connected to the corresponding peripheral side faces 6A and 6A' the opposed other flange 3A.

The method of winding the windings, and that of connecting the winding terminals are suitably modified in accordance with the kind of the surface mount self-induction component and the number of windings to be used. When one winding is to be used, for example, the input and output terminals may be respectively connected to electrodes formed on the corresponding peripheral side faces 6B and 6B of the flange 3B or one of the opposed flanges, or respectively connected to electrodes formed on the corresponding peripheral side faces 6A and 6A' of the flange 3A or the other of the opposed flanges.

The connection of each winding is performed while bending the winding so as to elongate along the corresponding flange. In FIG. 8, a indicates a bent portion which is formed in the process of connecting the winding starting end a' of the winding Y to the flange peripheral side face 6A, and γ indicates a bent portion which is formed in the process of connecting the winding fishing end b of the winding X to the flange peripheral side face 6B'.

Similarly, the connections of the winding starting end a of the winding X and the winding finishing end b' of the winding Y are preferably performed while bending the windings so as to elongate along the corresponding flanges. According to this winding method, even when two or more windings are to be used, the winding process is completed by a single winding step, and the connections of the windings can be performed by means of machinery. Therefore, the productivity is improved. Since the connections of the windings are performed while bending the windings so as to elongate along the corresponding flanges as indicated by the portions a and γ, the winding terminals are stabilized, so that, even when an impact is applied or a collision occurs, a problem such as a breakage of a wire is prevented from arising.

Figure 9:
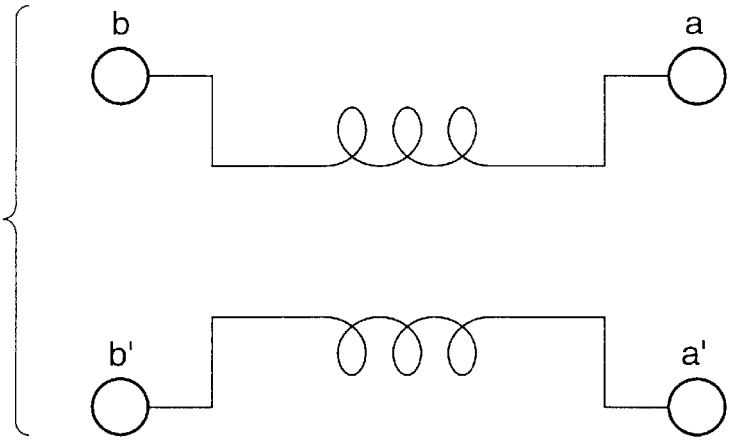
FIG. 9 is an equivalent circuit diagram of the common mode filter of FIG. 1.

According to the winding method, moreover, the distance between different poles of the coil terminals in an equivalent circuit diagram of the common mode filter shown in FIG. 9 are maximum, and hence superior dielectric properties are obtained. Even in the case where the component is to be miniaturized, the possibility of a short circuit is reduced.

In the invention, preferably, the connecting positions of the plate core are flat. Since there is no uneveness in the joining face, the joining accuracy is improved even in the case the plate core is joined to the drum core by means of machinery. In the view point of eliminating ferrite fine powder from being produced by collision of the cores, edges of the plate core are preferably chamfered.

Figure 10:
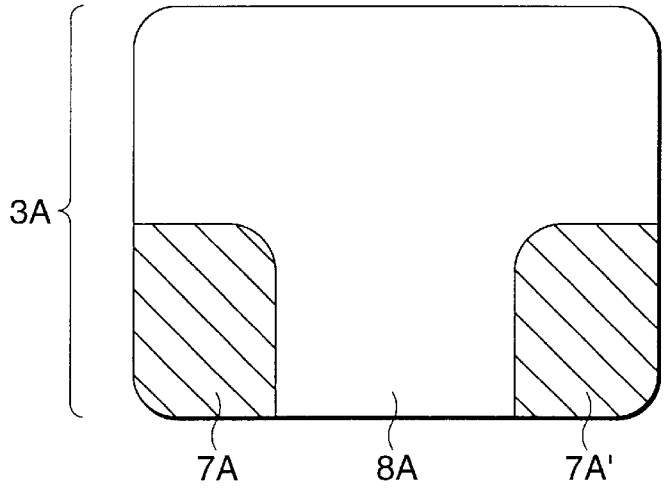
FIG. 10 shows a modification of the drum core of the common mode filter of the invention in which positions where the electrodes are formed are changed.

FIG. 10 shows a modification in which the positions where the electrodes are formed are changed.

Referring to FIG. 10, an electrode 7A and an electrode 7B (not shown), and an electrode 7A' and an electrode 7B' (not shown) which correspond to the electrodes 7A and 7B are formed on the back face 8A of the flange 3A and the back face 8B (not shown) of the flange 3B (not shown), respectively. In the embodiment,the four electrodes are formed in total. As described above, some of surface mount self-induction components use only one winding. In such a case, one electrode is formed in each of the back faces 8A and 8B. Although the component may be thinned also by employing the electrode positions shown in FIG. 10, the electrode positions shown in FIGS. 2 and 3 are more preferable in view of the possibility of a short circuit due to miniaturization of the component. Although not relating to the connections of the windings, lower-face electrodes (not shown) are preferably formed in accordance with a requirement in the process of soldering the component to a circuit board.

Figure 11:
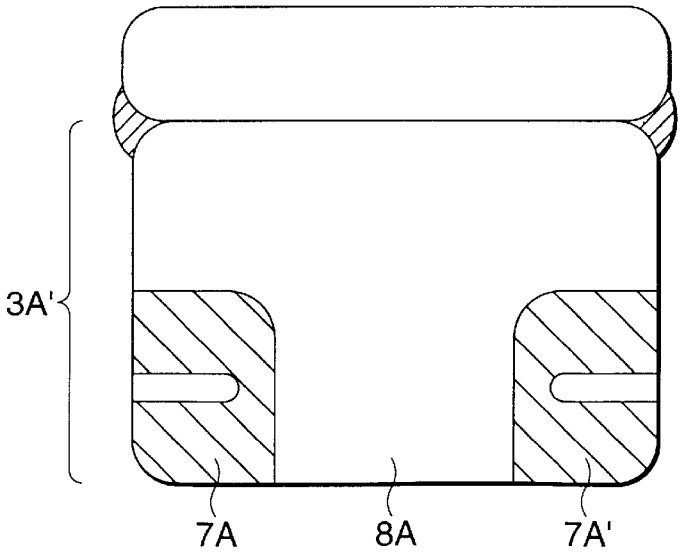
FIG. 11 shows a modification of portions where winding terminals are connected in the common mode filter of the invention.

In FIG. 11, the connections of the winding terminals are performed by the electrode 7A and the electrode 7B (not shown), and the electrode 7A' and the electrode 7B' (not shown) which correspond to the electrodes 7A and 7B. These electrodes are formed on the back face 8A of the flange 3A and the back face 8B (not shown) of the flange 3B (not shown). In any one of the configurations described above, the height of a product can be suppressed. In view of the possibility of a short circuit between electrodes due to miniaturization of a product, it is more preferable to perform connections by means of electrodes formed on the peripheral side faces of the flanges as shown in FIGS. 5 and 6.

The configuration of the invention may be applied also to other surface mount self-induction components such as a chip inductor and a chip inductor having a gap.

What is claimed is:

1. A surface mount self-induction component comprising:

a drum core having a winding core around which a winding is wound, and a pair of flanges which are opposedly placed at ends of said winding core, respectively, said pair of flanges having top faces, bottom faces opposite the top faces, and side faces between respective of the top faces and the bottom faces;

a plate core which elongates above the top faces of said pair of flanges; and electrodes which are respectively formed on the side faces of said opposed flanges between the bottom faces and the top faces, said side faces being parallel with an axial direction of said winding core, said winding being coupled to said electrodes, wherein input and output terminals of said winding are connected to respective of said electrodes formed on the corresponding side faces of said opposed flanges.

2. A surface mount self-induction component as claimed in claim 1, wherein a diameter of said winding is reduced by pressurizing or heating.

3. A surface mount self-induction component according to claim 1, wherein a chamfered portion is formed in an edge of each of said opposed flanges.

4. A surface mount self-induction component according to claim 1, wherein said winding core has a rectangular section shape, and has a chamfered portion in each edge.

5. A surface mount self-induction component according to claim 1, wherein said drum core is joined to said plate core by an ultraviolet curing resin.

6. A surface mount self-induction component according to claim 1, wherein said electrodes are respectively formed on opposite side faces of said pair of opposed flanges, two windings are wound around said winding core, and connections of terminals of said windings are realized by means of electrodes formed on said side faces.

7. A surface mount self-induction component according to claim 6, wherein connections of input and output terminals of one of said windings and said electrodes are realized by means of electrodes formed on corresponding peripheral side faces of one of said opposed flanges, and connections of input and output terminals of another one of said windings are realized by means of electrodes formed on corresponding peripheral side faces of another of said opposed flanges.

8. A surface mount self-induction component comprising:

a drum core having a winding core around which a winding is to be wound, and a pair of flanges which are opposedly placed at ends of said winding core, respectively, said pair of flanges having top faces, bottom faces opposite to the top faces, and back faces between respective of the top faces and the bottom faces;

a plate core which elongates above top faces of said pair of flanges; and electrodes which are respectively formed on the back faces of said opposed flanges between the top faces and the bottom faces, said winding having terminals coupled to said electrodes formed on said back faces of said opposed flanges, wherein said component has a height of less than 1.8 mm and an allowable current greater than 200 mA.

9. A surface mount self-induction component according to claim 8, wherein two electrodes are formed on a back face of each of said pair of opposed flanges, two windings are wound around said winding core, and connections of terminals of said windings are realized by means of electrodes formed on said back faces of said flanges.

10. A surface mount self-induction component according to claim 9, wherein connections of input and output terminals of one of said windings and said electrodes are realized by means of electrodes formed on corresponding peripheral side faces of one of said opposed flanges, and connections of input and output terminals of another one of said windings are realized by means of electrodes formed on corresponding peripheral side faces of another one of said opposed flanges.

11. A surface mount self-induction component according to claim 8, wherein a chamfered portion is formed in an edge of each of said opposed flanges.

12. A surface mount self-induction component according to claim 8, wherein said winding core has a rectangular section shape, and has a chamfered portion in each edge.

13. A surface mount self-induction component according to claim 8, wherein said drum core is joined to said plate core by an ultraviolet curing resin.

14. A surface mount self-induction component according to claim 8, wherein connections of input and output terminals of said windings and said electrodes are realized by means of electrodes formed on corresponding peripheral side faces of one of said opposed flanges.

* * * * *